US005790630A

United States Patent [19]

Watanabe et al.

[11] Patent Number: 5,790,630

[45] Date of Patent: *Aug. 4, 1998

[54] RADIATION WINDOW AND RADIATION SYSTEM USING THE SAME

[75] Inventors: Yutaka Watanabe, Takanezawamachi; Shigeru Terashima, Utsunomiya, both of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 697,863

[22] Filed: Aug. 30, 1996

[30] Foreign Application Priority Data

Aug. 31, 1995 [JP] Japan ..... 7-223570

[51] Int. Cl.[6] ..... G21K 1/00

[52] U.S. Cl. ..... 378/161; 378/34

[58] Field of Search ..... 378/161, 34

[56] References Cited

U.S. PATENT DOCUMENTS 5,159,621 10/1992 Watanabe et al. ..... 378/161

5,350,923 9/1994 Bassignana et al. ..... 378/161

*Primary Examiner*—Don Wong

*Attorney, Agent, or Firm*—Fitzpatrick, Cella, Harper & Scinto

[57] ABSTRACT

A radiation window includes a radiation transmitting window material, a supporting frame for gas-tightly supporting an outer periphery of the radiation transmitting window material, a flange for gas-tightly supporting an outer periphery of the supporting frame, and a structure for reducing a stress related to mounting the supporting frame onto the flange.

7 Claims, 11 Drawing Sheets

RADIATION WINDOW AND RADIATION SYSTEM USING THE SAME

FIELD OF THE INVENTION AND RELATED ART

This invention relates to a radiation window for extracting radiation rays from a radiation source into a different ambience and to a radiation system such as an exposure apparatus, for example, using such radiation window.

FIG. 12 shows an example of a known radiation window, and it illustrates a sectional structure of an X-ray transmitting window for synchrotron radiation light. X-ray transmission film 91 made of a material such as beryllium, for example, has an outer circumferential edge on which an adjoining member 92 is attached. The combined structure is adhered to an inner circumferential surface of a base frame 93, gas-tightly. The adhesion is performed by using silver soldering, electron beam welding, or diffusion welding, for example. The base frame 93 has screw bores 94 formed therein, and by using bolts, it is fixed as a vacuum partition wall.

FIG. 13 shows a sectional structure of another example. X-ray transmission film 102 formed of a material such as beryllium has an outer circumferential edge on both side faces to which gaskets 103 are attached. The combined structure is sandwiched by flanges 104 and 105, and it is gas-tightly held with sealing edges **104*b* and 105*b* of the flanges biting at the gaskets 103. The tightening of the flanges 104 and 105 is achieved by using bolts 106 and 108**.

In these examples, plural bolts (usually of a number six (6) or more) are used for the tightening. However, if these bolts are tightened sequentially, during the assembling the tightening force to the flange varies sequentially. Within the flange, a twisting force is produced along a plane parallel to the surface of the radiation transmitting film, and this twisting force varies sequentially. Also, for the tightening of bolts of the flange, in many cases the bolts are tightened manually by an operator. Thus, there is a possibility of dispersion of bolt tightening forces (i.e., eccentric tightening). Particularly, eccentric tightening produces a large twisting force.

In the examples described above, the radiation transmitting film is mounted to the flange with high rigidity. As a result, twisting of flange directly acts as a stress to the radiation transmitting film. Brittle materials such as beryllium, Si, SiC, SiN or diamond, for example, usable as a radiation transmitting film, produce only a very small plastic deformation in response to application of stress, and the film can be easily broken. Particularly, since beryllium has a toxicity, production of fractions resulting from breakage of beryllium will be a large problem with respect to environment safety.

For these reasons, when bolts of the flange are tightened, very careful operations are necessary, such as gradually enlarging the bolt tightening force so that the stress produced in the radiation transmitting film does not grow beyond the limit of film breakage.

SUMMARY OF THE INVENTION

It is an object of the present invention to provide a radiation window with a structure having a smaller possibility of window breakage.

It is another object of the present invention to provide a radiation system such as an exposure apparatus having such radiation window.

In accordance with an aspect of the present invention, there is provided a radiation window, comprising: a radiation transmitting window material; a supporting frame for gas-tightly supporting an outer periphery of said radiation transmitting window material; a flange for gas-tightly supporting an outer periphery of said supporting frame; and means for reducing a stress related to mounting said supporting frame onto said flange.

In accordance with another aspect of the present invention, there is provided a radiation window, comprising: a radiation transmitting window material; a supporting frame for gas-tightly supporting an outer periphery of said radiation transmitting window material; and a flange for gas-tightly supporting an outer periphery of said supporting frame; wherein said supporting frame has a small- thickness portion.

Said small-thickness portion may preferably be defined by a groove formed in said supporting frame, or by a plate-like member.

Said radiation window may preferably be used with radiation which contains X-rays.

Said radiation transmitting window material may preferably comprise one of beryllium, Si, SiC, SiN and diamond.

In accordance with a further aspect of the present invention, there is provided a radiation system which comprises a radiation source and a radiation window in any one of the forms as described above, for extracting radiation from the radiation source.

Said radiation system may further comprise means for exposing a substrate with the radiation.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

[Embodiment 1]

Figure 1A:
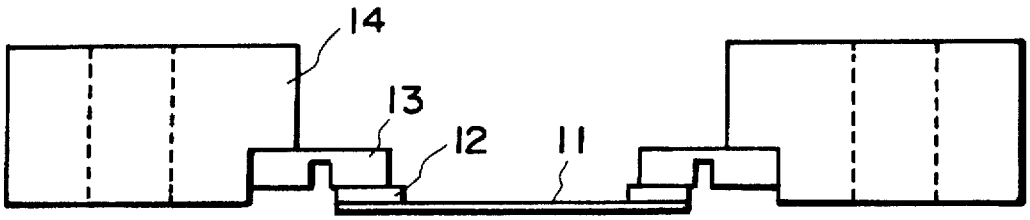
FIGS. 1A–1C are sectional views for explaining a first embodiment of the present invention.
Figure 1B:
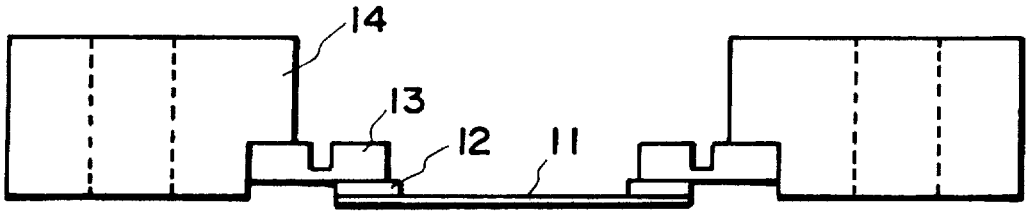
Figure 1C:
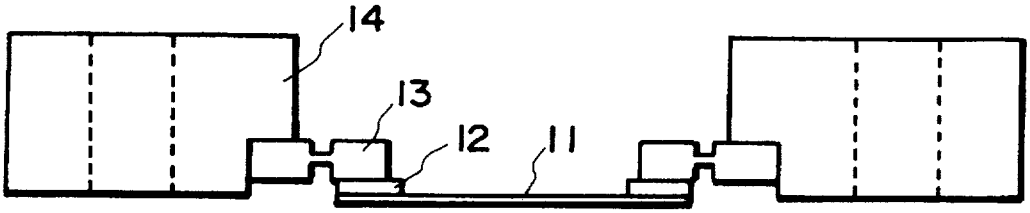

FIGS. 1A–1C are sectional views of a first embodiment of the present invention. In this embodiment, the invention is applied to an X-ray extracting window for extracting synchrotron radiation light from a synchrotron radiation source.

A diamond film of a thickness 4 microns is formed on a Si (silicone) substrate through a CVD process and, by circularly back-etching it, an X-ray transmitting film 11 of diamond is obtained as a self-sustaining film upon a ring-like substrate 12. With regard to the thickness of the Si substrate, several hundred microns is sufficient. By using an adhesive agent of an epoxy series, the ring-like substrate 12 is gas-tightly adhered and fixed to a ring-like supporting frame 13 which is formed with a circular groove to define a partial small-thickness portion. Further, by using an epoxy series adhesive material, the ring-like supporting frame 13 is gas-tightly adhered to a flange 14. Since epoxy series adhesive agents have a high heat resistance and show small degasification in a vacuum, they can be suitably used particularly in a vacuum system that needs a high vacuum, as in the present embodiment. However, any other thermosetting resin may be used provided that it has a high heat resistance. Further, in place of an organic series adhesive agent, silver soldering, electron beam welding or diffusion welding, for example, may be used for the adhesion.

The flange 14 is provided with a sealing mechanism, such as a seal edge or an O-ring of rubber or metal, for example, for allowing gas-tight junction with another flange.

With regard to the position where the stress reducing or releasing groove is to be provided, it may be on the bottom face of the supporting frame 13 as shown in FIG. 1A, or on the top face of the supporting frame 13 as shown in FIG. 1B. Alternatively, grooves may be formed on the top and bottom faces of the supporting frame 13 as shown in FIG. 1C.

In the structure described above, deformation of the flange as the flange is tightened by bolts can be absorbed by deformation of the small-thickness portion at the groove. Thus, the inside of the supporting frame 13 where the substrate is gas-tightly fixed is not deformed and, therefore, the possibility of breakage of the X-ray transmitting film is reduced considerably.

In place of adhering the ring-like supporting frame 13 to the flange, a frame member integral with the flange 14 may be provided.

With regard to the X-ray transmitting film, a film of brittle material such as SiC or SiN, for example, may be formed through a CVD process and used. A film of silicone can be formed by doping a Si substrate with boron and by back-etching it from the back, while using a different etching rate for silicone and boron.

[Embodiment 2]

Figure 2:
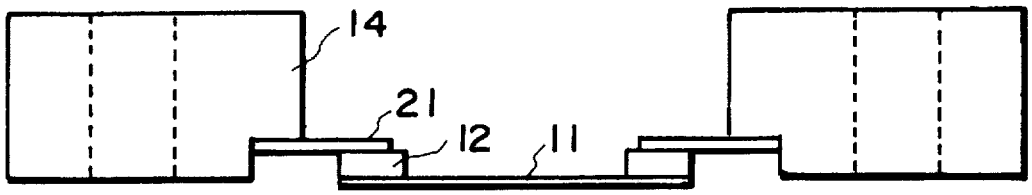
FIG. 2 is a sectional view for explaining a second embodiment of the present invention.

FIG. 2 is a sectional view of a second embodiment of the present invention. X-ray transmitting film 11 and ring-like substrate 12 are formed as an integral structure, by forming a diamond film of a thickness 4 microns upon a Si substrate of a thickness 5 mm through a CVD process and by circularly back-etching it. The ring-like Si substrate 12 is gas-tightly fixed to a ring-plate-like supporting frame 21 of stainless steel of a thickness 200 microns, by using an epoxy series adhesive agent. Further, the ring-plate-like supporting frame 21 is gas-tightly fixed to a flange 14 by using an epoxy series adhesive agent.

In this embodiment, the Si substrate has a thickness of 5 mm, a sufficient thickness. Deformation of the flange can be absorbed by a small-thickness portion of the ring-plate-like supporting frame 21, and thus the Si substrate is not deformed. Therefore, breakage of the X-ray transmitting film 11 comprised of diamond (brittle material) is avoided.

[Embodiment 3]

Figure 3A:
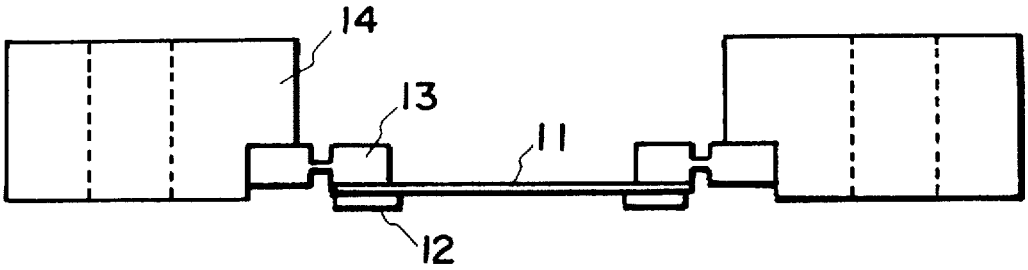
FIGS. 3A–3C are sectional views for explaining a third embodiment of the present invention.
Figure 3B:
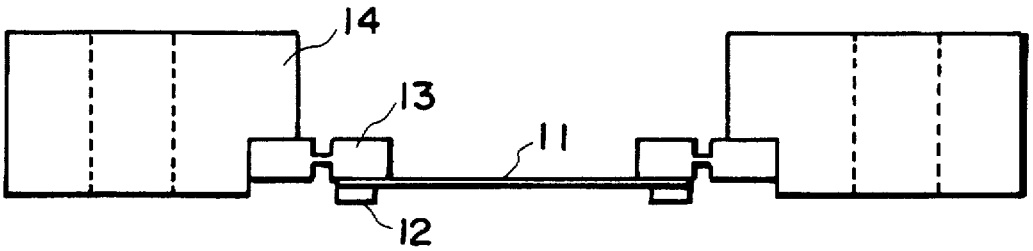
Figure 3C:
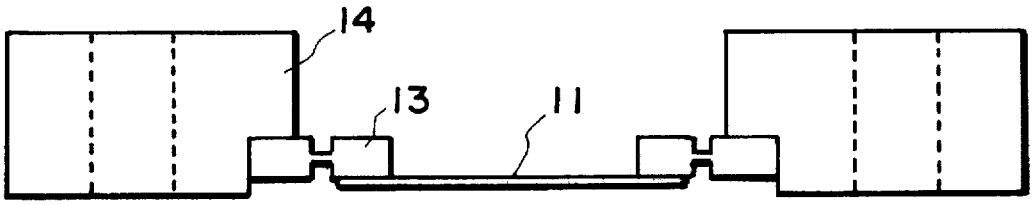

FIGS. 3A–3C are sectional views of a third embodiment of the present invention. In this embodiment, an X-ray transmitting film is gas-tightly adhered to a supporting frame. Because the opening of the X-ray transmitting film is the same size as the region where the film is self-sustained, there are choices with regard to the diameter of the opening of the substrate and the diameter of opening of the supporting film, as shown in FIGS. 3A and 3B. The diameter of opening of the substrate may be made small (FIG. 3A) or the diameter of opening of the substrate may be made large (FIG. 3B). Moreover, it is possible to completely remove the substrate (FIG. 3C).

Figure 4A:
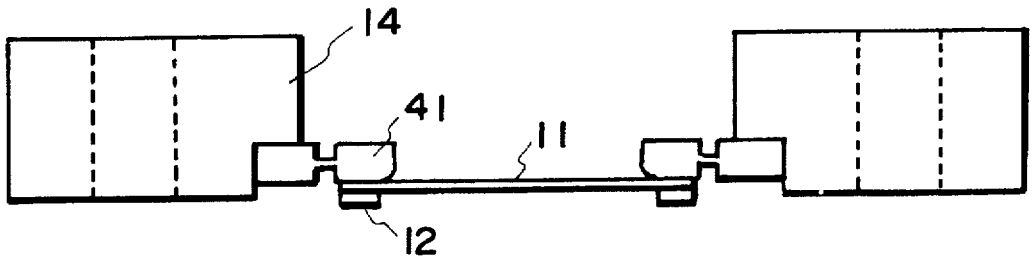
FIGS. 4A and 4B are sectional views for explaining the third embodiment.
Figure 4B:
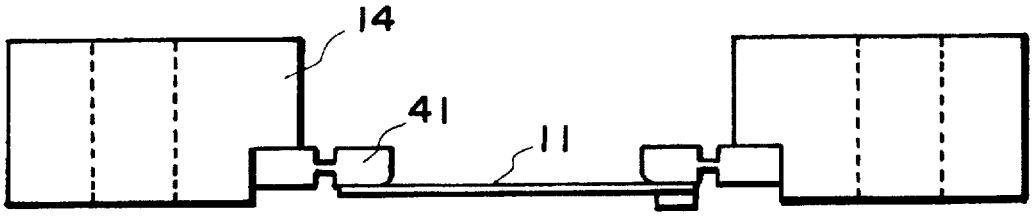

If the diameter of opening of the substrate is to be made small, because the outermost portion (fixed portion) of the x-ray transmitting film remains as originally formed by a CVD process, it does not rely on the machining precision of the finished surface of the supporting frame. If on the other hand the diameter of opening of the substrate is made large, it is necessary to sufficiently increase the machining precision of the finished surface of the supporting frame and also to carefully avoid collection of adhesive agent. This applies also to a case where the substrate is completely removed. To the contrary, in a case where the diameter of the opening of the substrate is made sufficiently large or the substrate is completely removed, the innermost portion of the supporting frame 41 may be rounded and, additionally, when it is mounted to the flange, the vacuum side or lower-pressure side of the X-ray transmitting film may be disposed facing up as viewed in FIG. 4A or 4B. In this embodiment, the periphery of the self-sustaining portion of the X-ray transmitting film abuts against a suitably rounded portion of the supporting frame. This effectively reduces the risk of breakage of the X-ray transmitting film, from a portion around the self-sustaining portion. Thus, pressure resistance of X-ray transmitting film is improved.

[Embodiment 4]

Figure 5:
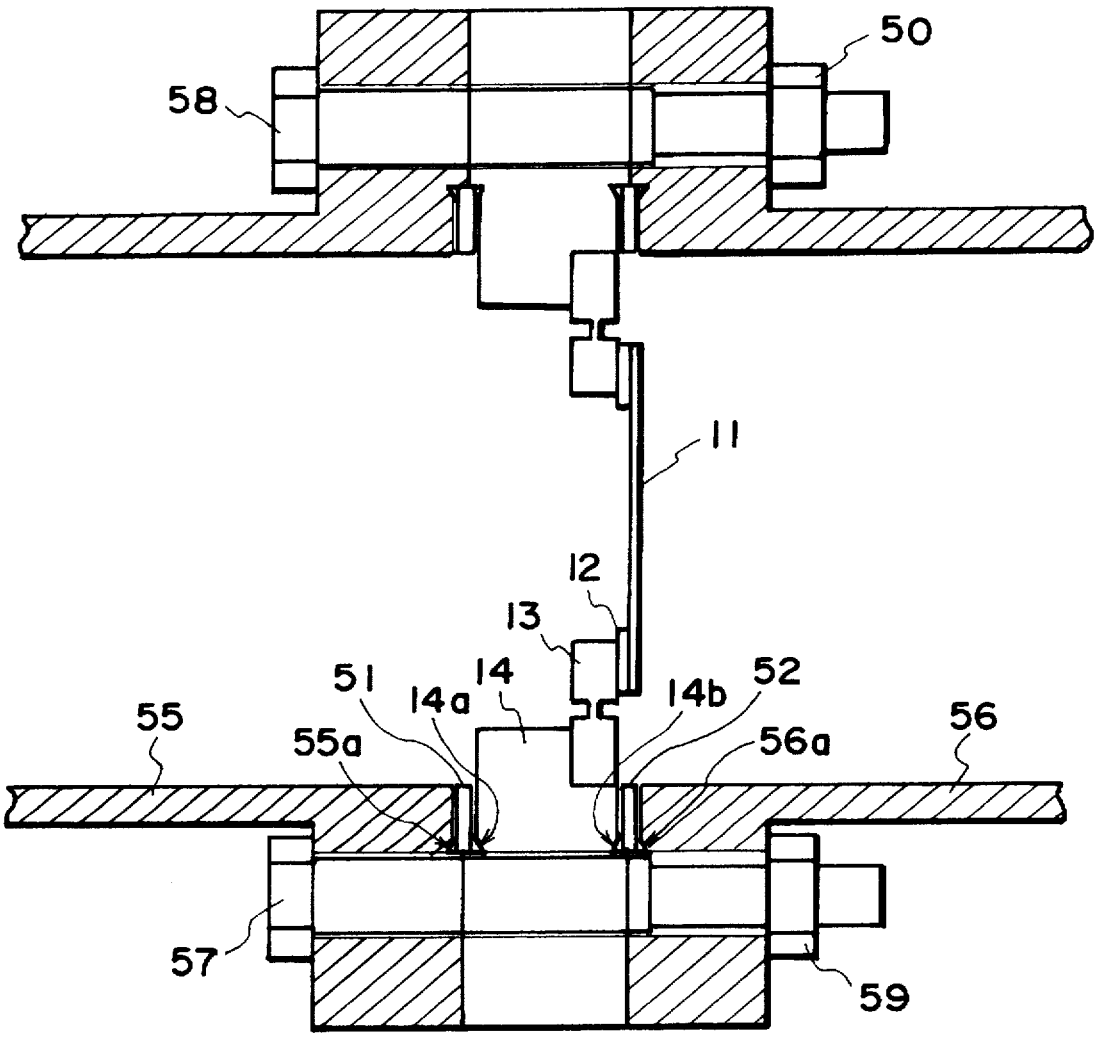
FIG. 5 is a sectional view for explaining a fourth embodiment of the present invention.

FIG. 5 is a sectional view of a fourth embodiment of the present invention. Flanges 55 and 56 have sealing edges **55*a* and 56*a*, respectively. Flange 14 has sealing edges 14*a* and 14*b*** at its opposite side faces.

The flange 14 and flanges 55 and 56 sandwich therebetween copper gaskets 51 and 52. By tightening bolts 57 and 58 (actually, six bolts are uniformly distributed along a circumference), respective sealing edges bite into the copper gaskets 51 and 52, to thereby provide vacuum sealing.

When these bolts are tightened, the flange 14 will be deformed. However, this deformation is absorbed by a small-thickness portion of the groove, such that the inside of the supporting frame where the substrate is gas-tightly fixed is not deformed. As a result, breakage of the X-ray transmitting film 11 comprised of diamond (brittle material) is avoided.

[Embodiment 5]

Figure 6A:
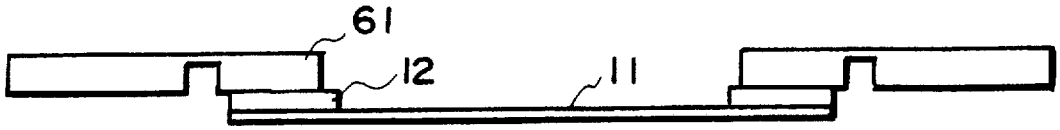
FIGS. 6A–6C are sectional views for explaining a fifth embodiment of the present invention.
Figure 6B:
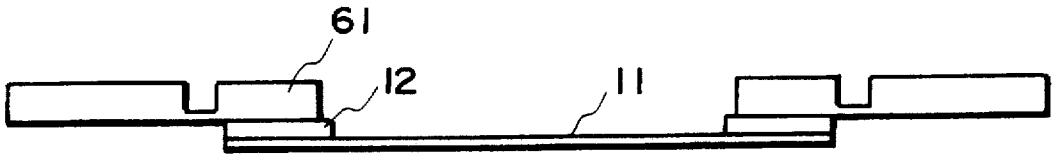
Figure 6C:
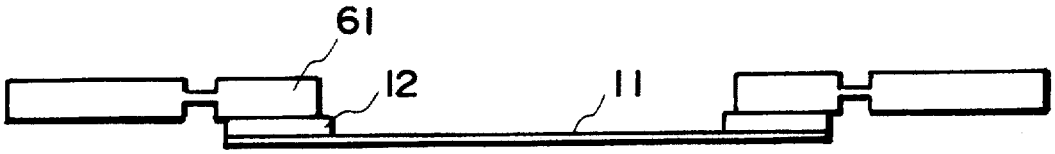

FIGS. 6A–6C are sectional views of a fifth embodiment of the present invention. SiC film of a thickness 4 microns is formed on a Si (silicone) substrate through a CVD process and, by circularly back-etching it, an X-ray transmitting film 11 of SiC is obtained as a self-sustaining film upon a ring-like substrate 12. With regard to the thickness of the Si substrate, a several hundred microns is sufficient. By using an adhesive agent of an epoxy series, the ring-like substrate 12 is gas-tightly adhered and fixed to a ring-like supporting frame 61 which is formed with a circular groove. With regard to the material of the ring-like supporting frame, materials such as copper or aluminum, for example, having a Brinell hardness smaller than that of stainless steel, are preferable. The mounting of this X-ray transmitting window will be described later. With the biting of the stainless steel sealing edge, vacuum sealing is achieved.

With regard to the stress reducing or releasing groove, it may be formed in any of the manners illustrated in FIGS. 6A–6C. In this embodiment, the stress applied to the ring-like supporting frame 61 is absorbed by the groove portion, such that the inside of the supporting frame 13 where the substrate is gas-tightly fixed is not deformed. Thus, breakage of X-ray transmitting film 11 comprised of SiC (brittle material) is avoided.

[Embodiment 6]

Figure 7:
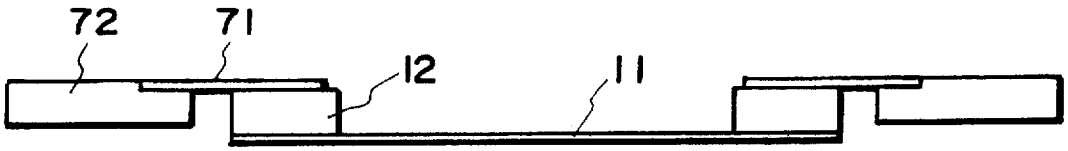
FIG. 7 is a sectional view for explaining a sixth embodiment of the present invention.

FIG. 7 is a sectional view of a sixth embodiment of the present invention. SiC film of a thickness 4 microns is formed on a Si substrate of a thickness 5 mm, through a CVD process and, by circularly back-etching it, an X-ray transmitting film 11 of SiC is obtained as a self-sustaining film upon a ring-like substrate 12. By using an adhesive agent of an epoxy series, the ring-like Si substrate 12 is gas-tightly adhered and fixed to a ring-plate-like supporting frame 71 made of stainless steel material and having a thickness of 200 microns. Further, the ring-plate-like supporting frame 71 is gas-tightly fixed to a ring-like supporting frame 72 by using an epoxy series adhesive agent. With regard to the material of the ring-like supporting frame 72, materials such as copper or aluminum, for example, having a Brinell hardness smaller than that of stainless steel, are preferable. The mounting of this X-ray transmitting window will be described later. With the biting of the stainless steel sealing edge, vacuum sealing is achieved.

In this embodiment, the Si substrate has a thickness of 5 mm, a sufficient thickness. Deformation of the flange can be absorbed by a small-thickness portion of the ring-plate-like supporting frame 71, and thus the Si substrate 12 is not deformed. Therefore, breakage of X-ray transmitting film 11 comprised of diamond (brittle material) is avoided.

In this embodiment, the ring-plate-like supporting frame 71 is gas-tightly fixed to the ring-like supporting frame 72 by using an epoxy series adhesive agent. This is for simplification of machining of parts. On the other hand, to achieve a high vacuum, less use of an adhesive agent is preferable. Thus, the members 71 and 72 may be formed into an integral structure to reduce the use of an adhesive agent.

[Embodiment 7]

Figure 8:
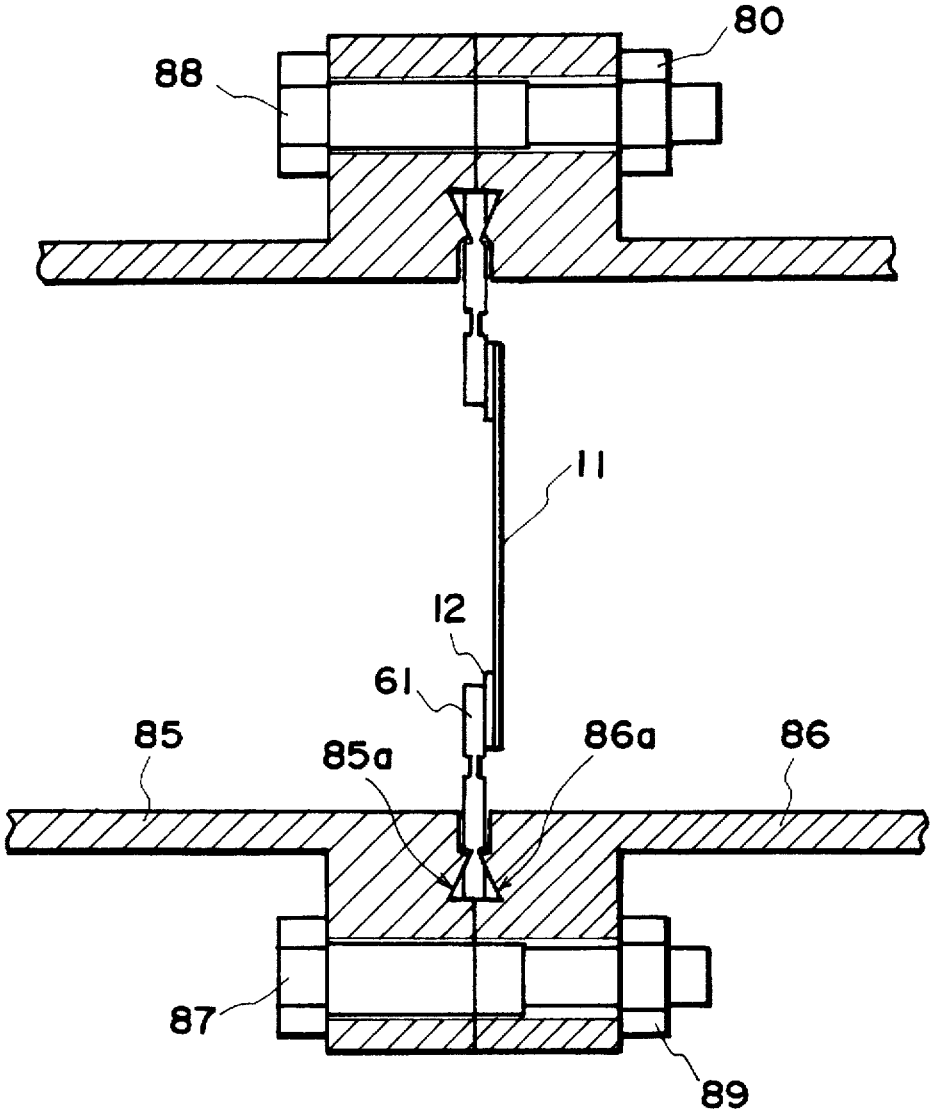
FIG. 8 is a sectional view for explaining a seventh embodiment of the present invention.

FIG. 8 is a sectional view of a seventh embodiment of the present invention. Flanges 85 and 86 have sealing edges **85*a* and 86*a*, respectively. By tightening bolts 87 and 88 (actually, six bolts are distributed along a circumference), respective sealing edges bite into the ring-like supporting frame 61**, to thereby provide vacuum sealing.

When these bolts are tightened, generally the ring-like supporting frame 61 will be deformed. However, this deformation is absorbed by a small-thickness portion of the groove, such that the inside of the supporting frame 61 where the substrate is gas-tightly fixed is not deformed. As a result, breakage of the X-ray transmitting film 11 comprised of SiC (brittle material) is avoided.

[Embodiment 8]

Figure 9:
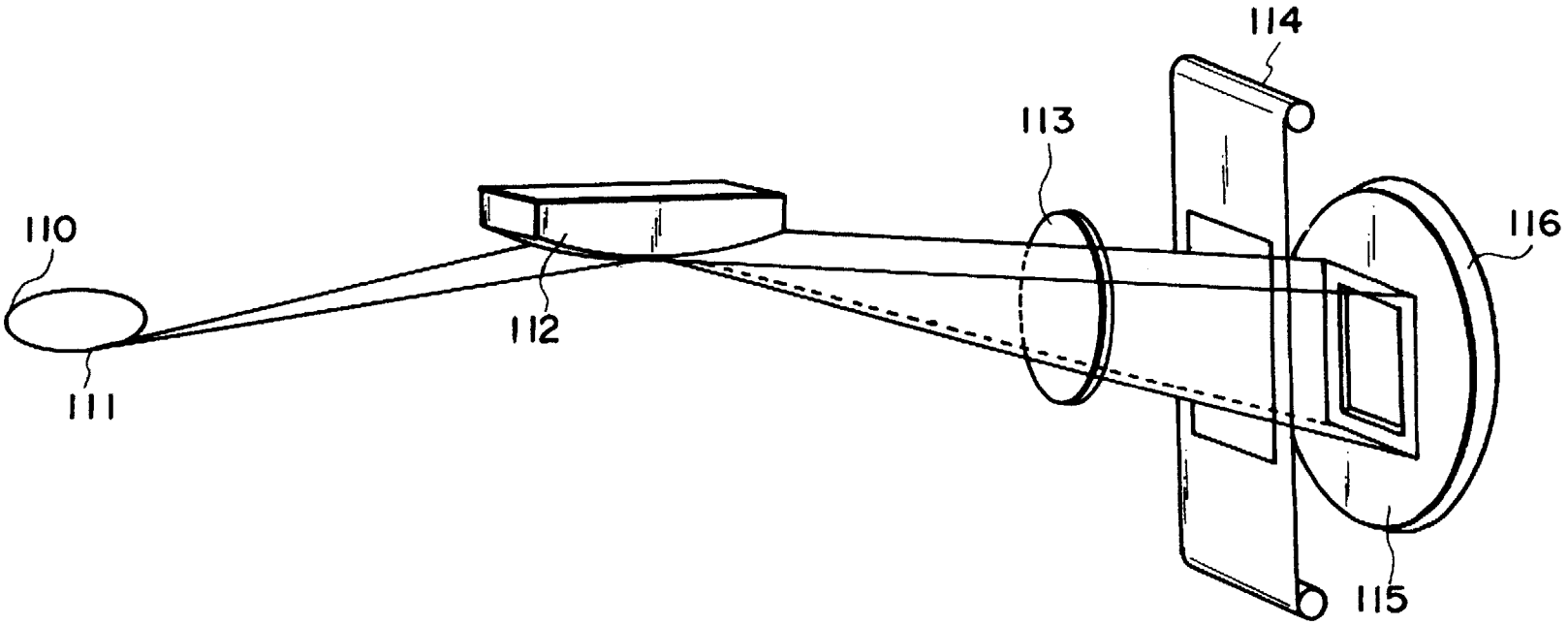
FIG. 9 is a schematic view, illustrating the general structure of an X-ray exposure apparatus.

Next, an embodiment of an X-ray exposure apparatus using an X-ray mask, will be explained. FIG. 9 is a schematic view of a general structure of an X-ray exposure apparatus. In the drawing, synchrotron radiation light of sheet-beam shape emitted from a light emission point 111 of a synchrotron radiation source 110, is expanded by a convex mirror 12 having a small curvature, in a direction perpendicular to a radiation orbit plane. The thus expanded radiation light goes through a radiation window 113 having a structure as described with reference to any one of the preceding embodiments. Then, by means of a movable shutter 114, the light is so adjusted that uniform exposure amount is achieved within an irradiation region, and the light is directed to an X-ray mask 115. The spacing between the X-ray mask 115 and a wafer 116 is about 30 microns, so that they are disposed close to each other. Through a stepping exposure process, the mask pattern is printed on different shot regions on the wafer 116, respectively.

[Embodiment 9]

Next, an embodiment of a microdevice manufacturing method using an X-ray mask and an X-ray exposure apparatus such as described above, will be explained. Microdevices may include semiconductor chips such as ICs or LSIs, liquid crystal devices, micro-machines or thin-film magnetic heads, for example. Here, a case of semiconductor device manufacture will be described.

Figure 10:
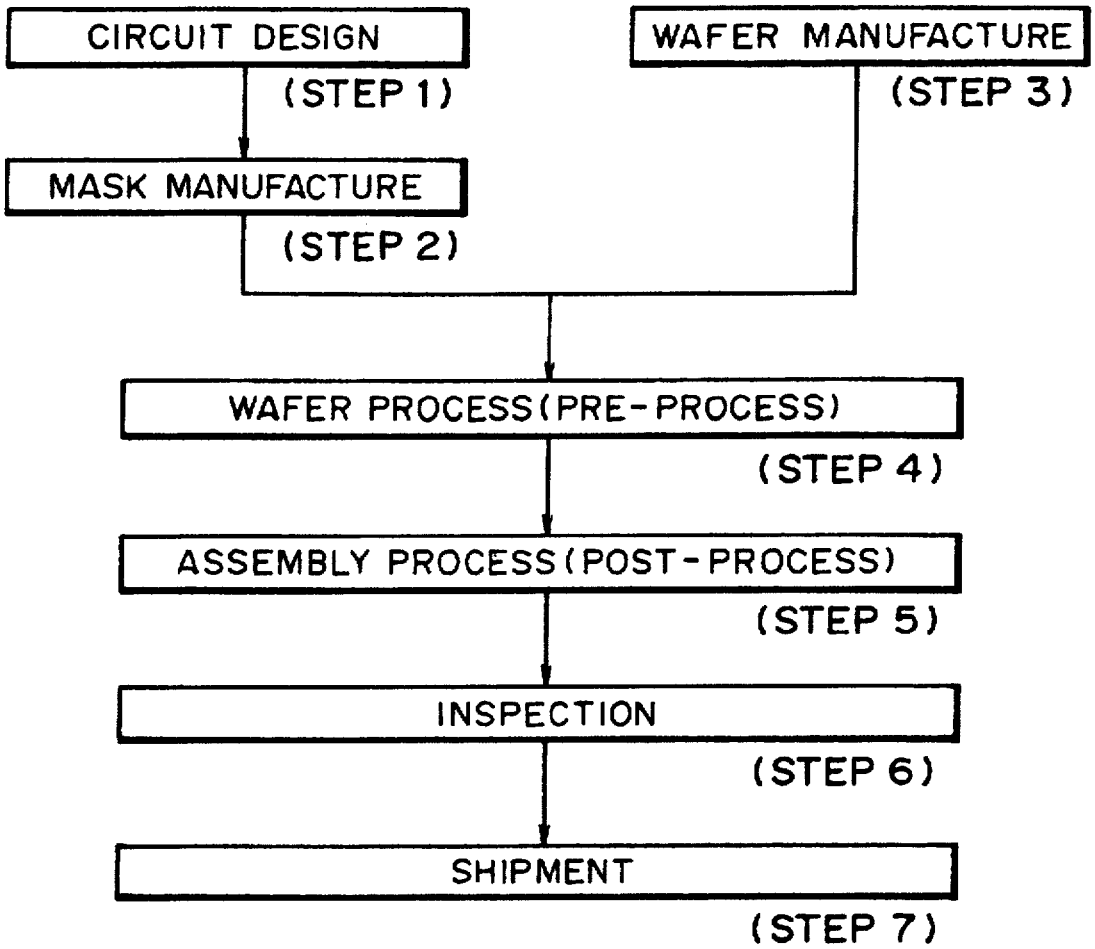
FIG. 10 is a flow chart for explaining semiconductor device manufacturing processes.

FIG. 10 is a flow chart showing the general sequence of semiconductor device manufacture. Step 1 is a design process for designing the circuit of a semiconductor device. Step 2 is a process for manufacturing a mask on the basis of the circuit pattern design. Step 3 is a process for manufacturing a wafer by using a material such as silicon. Step 4 is a wafer process which is called a pre-process wherein, by using the so prepared mask and wafer, circuits are practically formed on the wafer through lithography. Step 5 subsequent to this is an assembling step which is called a post-process wherein the wafer processed by step 4 is formed into semiconductor chips. This step includes assembling (dicing and bonding) and packaging (chip sealing). Step 6 is an inspection step wherein an operability check, a durability check and so on of the semiconductor devices produced by step 5 are carried out. After the completion of these processes, the semiconductor devices are shipped (step 7).

Figure 11:
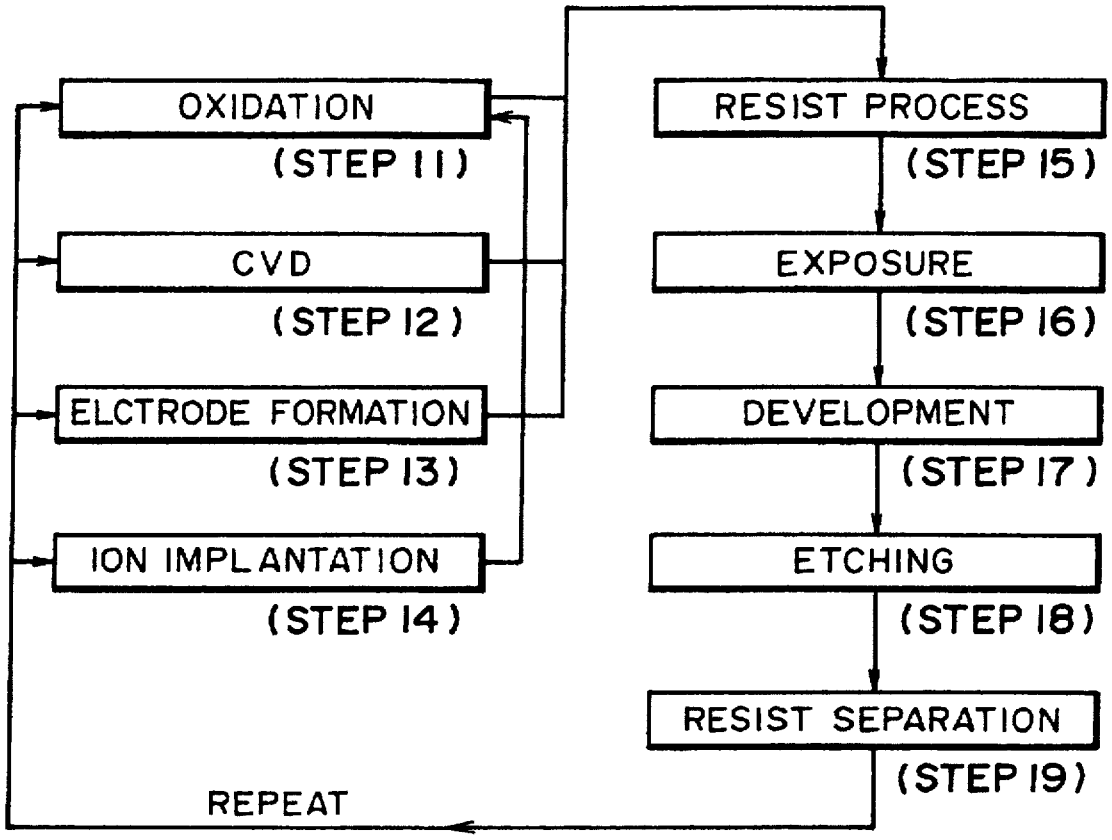
FIG. 11 is a flow chart for explaining details of a wafer process.
Figure 12:
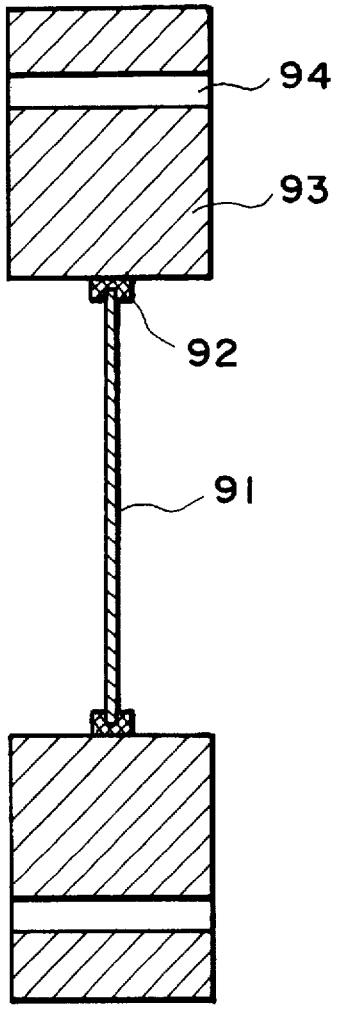
FIG. 12 is a sectional view for explaining the structure of a known example.
Figure 13:
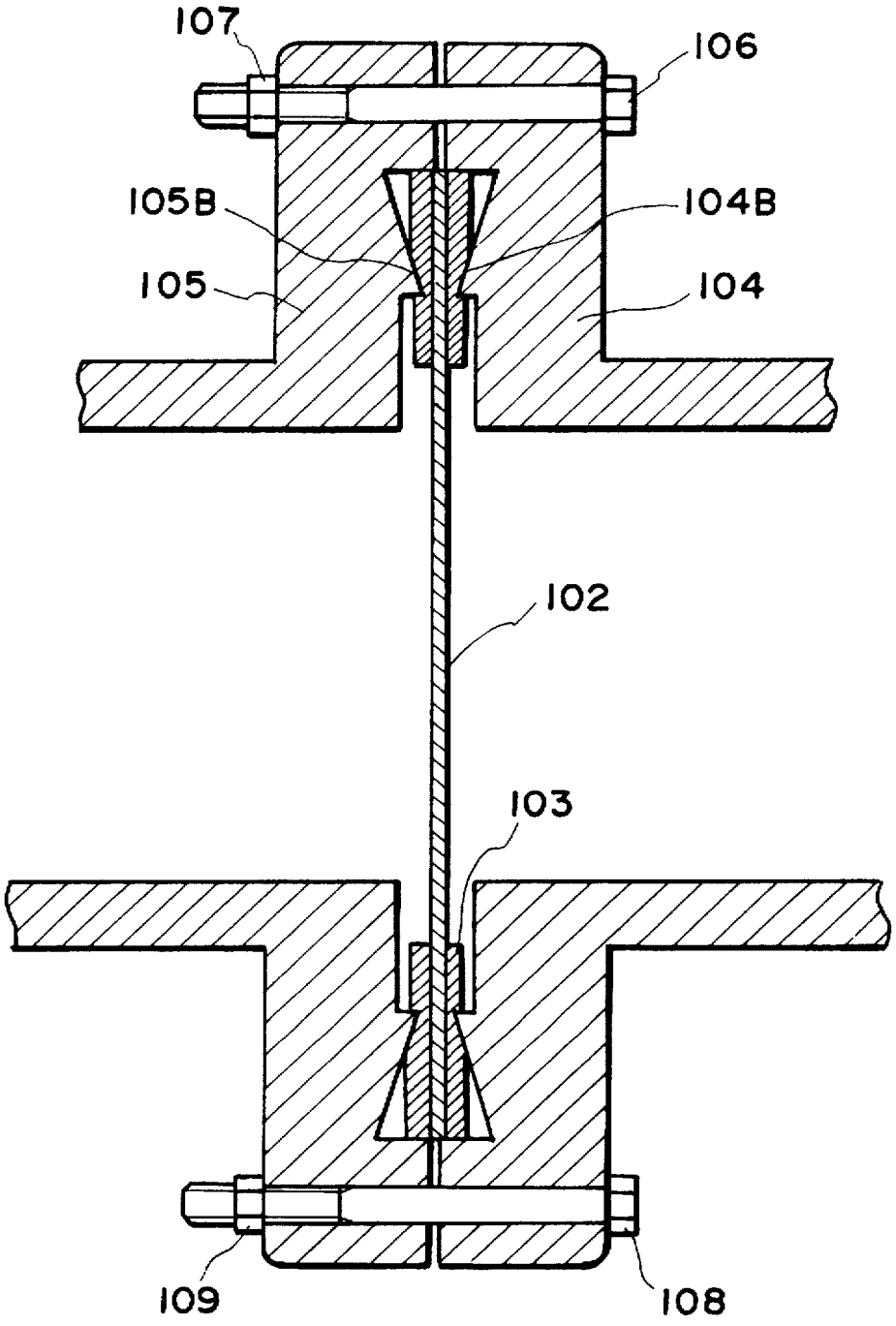
FIG. 13 is a sectional view for explaining the structure of another known example.

FIG. 11 is a flow chart showing details of the wafer process. Step 11 is an oxidation process for oxidizing the surface of a wafer. Step 12 is a CVD process for forming an insulating film on the wafer surface. Step 13 is an electrode forming process for forming electrodes on the wafer by vapor deposition. Step 14 is an ion implanting process for implanting ions to the wafer. Step 15 is a resist process for applying a resist (photosensitive material) to the wafer. Step 16 is an exposure process for printing, by exposure, the circuit pattern of the mask on the wafer through the exposure apparatus described above. Step 17 is a developing process for developing the exposed wafer. Step 18 is an etching process for removing portions other than the developed resist image. Step 19 is a resist separation process for separating the resist material remaining on the wafer after being subjected to the etching process. By repeating these processes, circuit patterns are superposedly formed on the wafer.

While the invention has been described with reference to the structures disclosed herein, it is not confined to the details set forth and this application is intended to cover such modifications or changes as may come within the purposes of the improvements or the scope of the following claims.

What is claimed is:

1. A radiation window for extracting X-ray radiation from a high vacuum ambience, comprising:

an X-ray transmitting film;

a supporting frame for gas-tightly supporting an outer peripheral portion of said X-ray transmitting film, said supporting frame having a primary portion with a first thickness and a secondary portion with a second thickness smaller than the first thickness; and a flange for gas-tightly supporting an outer periphery of said supporting frame, wherein the second thickness is smaller than the first thickness when said supporting frame is unsupported by said flange.

2. A radiation window according to claim 1, wherein said small-thickness portion is defined by a groove formed in said supporting frame.

3. A radiation window according to claim 1, wherein said small-thickness portion is defined by a plate-like member.

4. A radiation window according to claim 1, wherein the X-ray radiation comprises synchrotron radiation.

5. A radiation window according to claim 4, wherein said radiation transmitting window material comprises one of beryllium, Si, SiC, SiN or diamond.

6. A radiation system, comprising:

a radiation source emitting X-ray radiation; and a radiation window for extracting radiation from said radiation source, said radiation window comprising:

an X-ray transmitting film;

a supporting frame for gas-tightly supporting an outer peripheral portion of said X-ray transmitting film, said supporting frame having a primary portion with a first thickness and a secondary portion with a second thickness smaller than the first thickness; and a flange for gas-tightly supporting an outer periphery of said supporting frame, wherein the second thickness is smaller than the first thickness when said supporting frame is unsupported by said flange.

7. A radiation system according to claim 6, further comprising means for exposing a substrate with the radiation.

* * * * *